United States Patent [19]

Petracchi et al.

[11] 4,434,612

[45] Mar. 6, 1984

[54] FALSE TWIST DRAFTING DEVICE FOR CONTINUOUS WORKING OF SLUBBINGS OF TEXTILE MATERIALS

[76] Inventors: Ida Petracchi, Via Palasaccio 6; Antonietta Assirelli, Via C. Abba 69, both of Prato, Florence; Carlo Pacini, Via Paisiello 4, Calenzano, Florence; Cesare Pacini, Borgo Valsugana 28, Prato, Florence, all of Italy

[21] Appl. No.: 378,325

[22] Filed: May 14, 1982

[30] Foreign Application Priority Data

May 18, 1981 [IT] Italy ..... 9420 A/81
Dec. 9, 1981 [IT] Italy ..... 9584 A/81

[51] Int. Cl.[3] ..... D01H 5/28; D01H 5/18; D02G 1/04

[52] U.S. Cl. ..... 57/331; 57/337; 57/340

[58] Field of Search ..... 57/331, 334, 337–340

[56] References Cited

U.S. PATENT DOCUMENTS

| | | | |
|---|---|---|---|
| 2,522,332 | 9/1950 | Abbott | 57/331 X |
| 3,820,317 | 6/1974 | Raschle | 57/339 |
| 3,842,582 | 10/1974 | Richter | 57/339 X |
| 3,845,613 | 11/1974 | Knebel | 57/340 |
| 4,051,655 | 10/1977 | Lorenz et al. | 57/339 |

*Primary Examiner*—John Petrakes
*Attorney, Agent, or Firm*—McGlew and Tuttle

[57] ABSTRACT

Two offset and opposite rotating members have annular shoulders which are surrounded by frontal surfaces that are being at right angles to the axis of rotation of the members and partially opposed to each other. A first one of the members is mounted on a rotation drive shaft, and is made up of two faced disks, while the other one rests with its own shoulders on the shoulders of the first member and rests also on another point for mutual positioning of the members. Material to be processed may be easily inserted sideways between the two opposite members.

10 Claims, 16 Drawing Figures

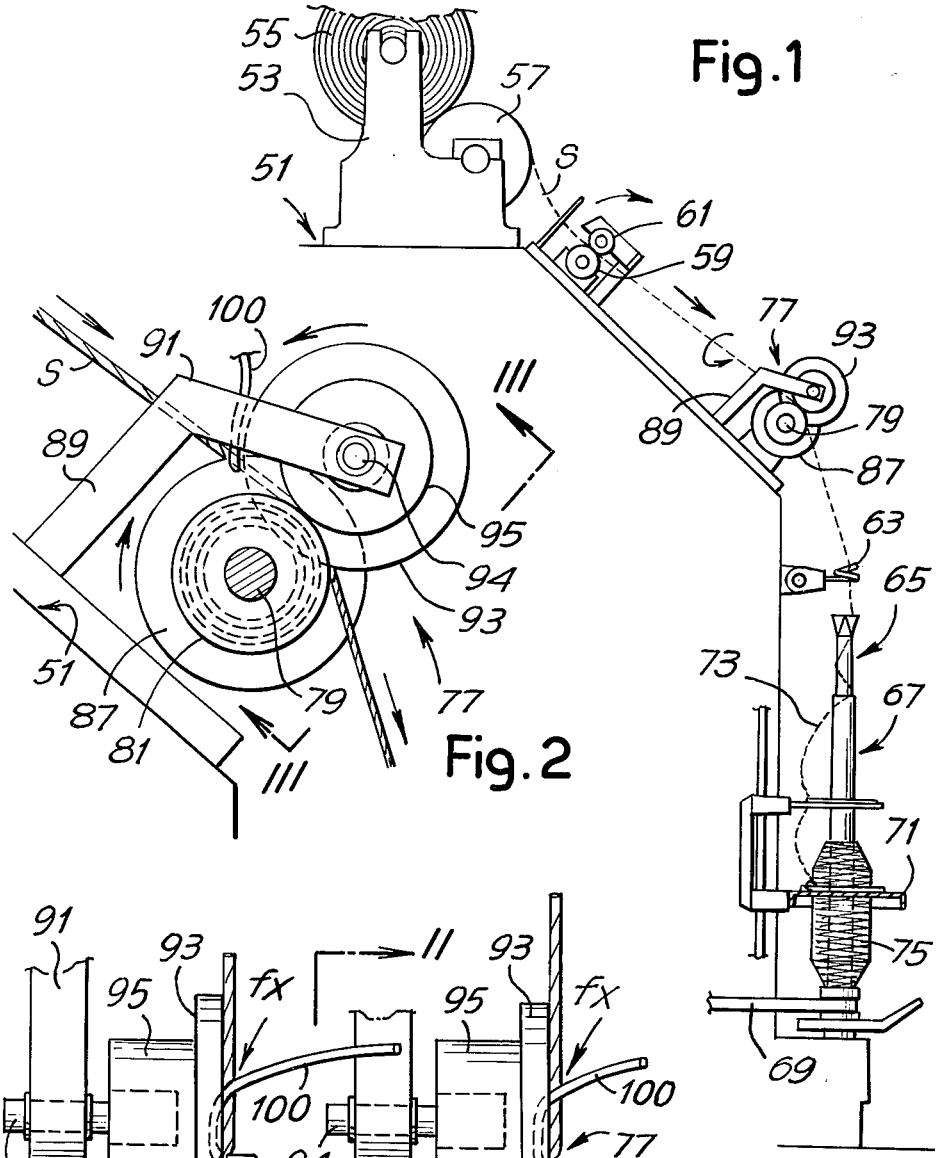
Fig.1
Fig.2
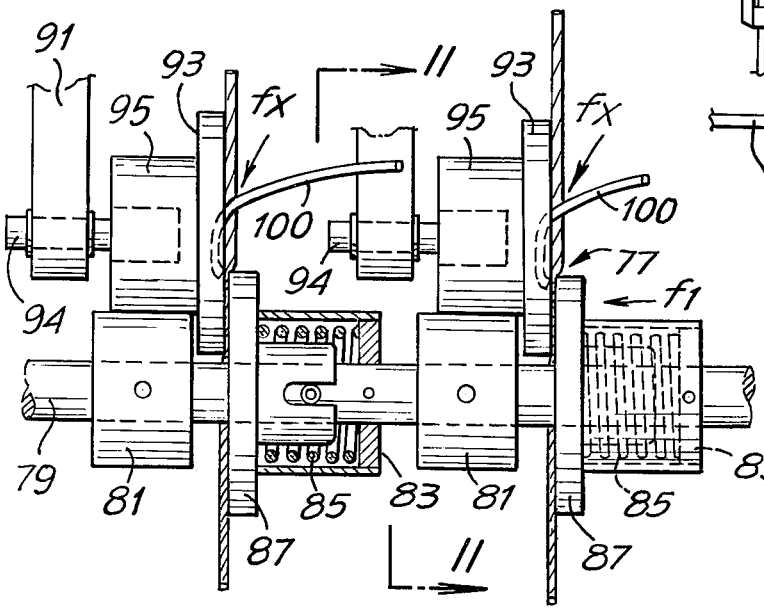
Fig.3

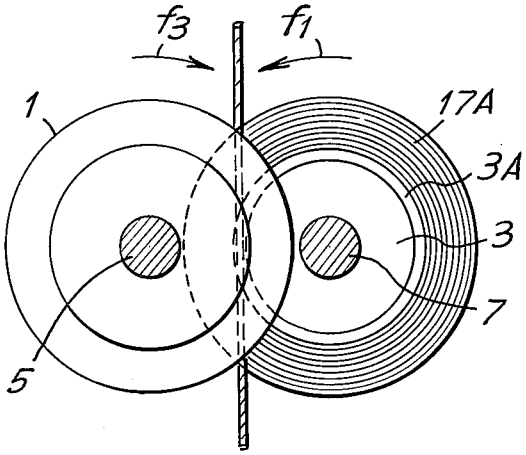
Fig.4
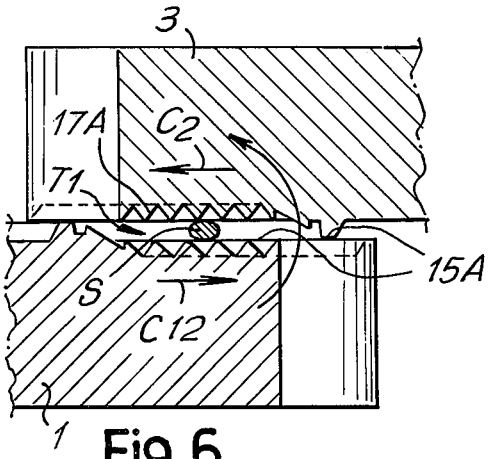
Fig.6
Fig.7
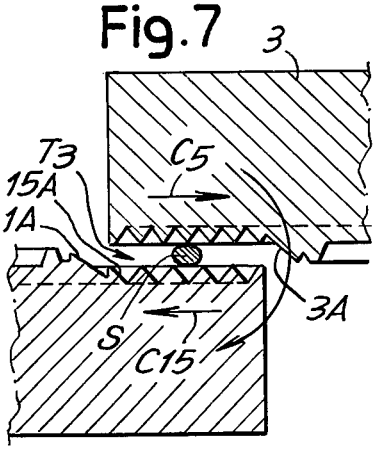
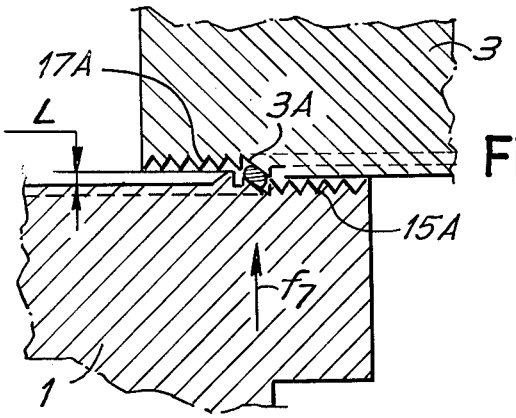
Fig.8 fs
S
T3
17A
T1
C2
C12
C1
VI
VI
f1
f3
3
7
C
VIII
VIII
5
1
C15
C5
15A
3A
1A
C3
VII
VII
T3
17A
15A
S
fs
T3

Fig.9
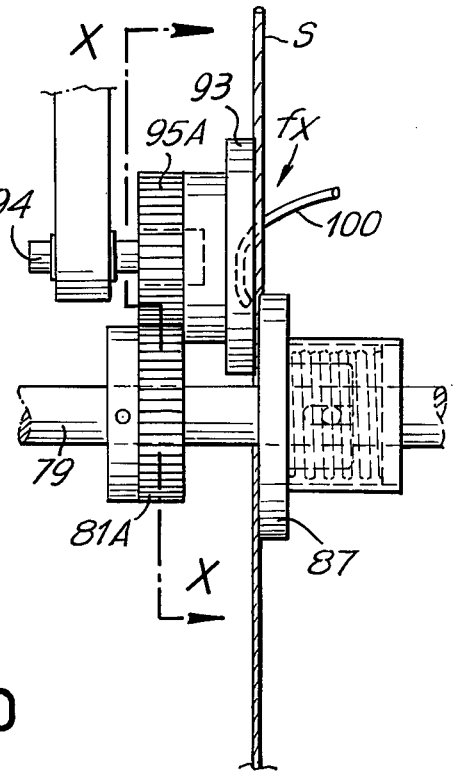
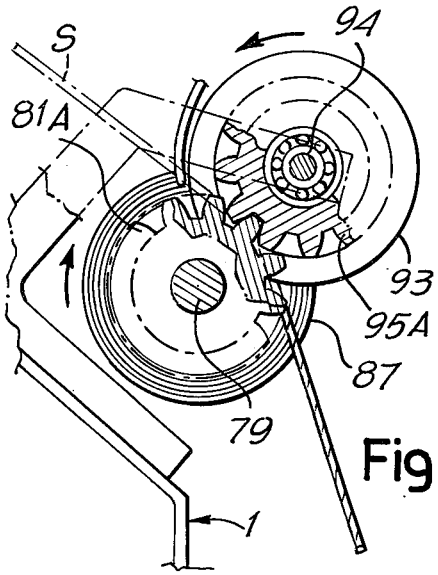
Fig.10
Fig.11
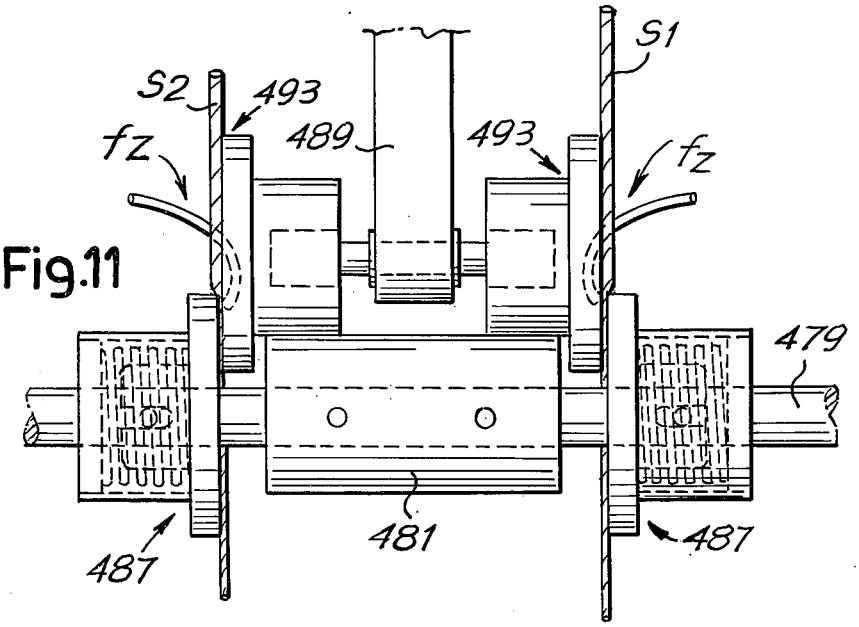

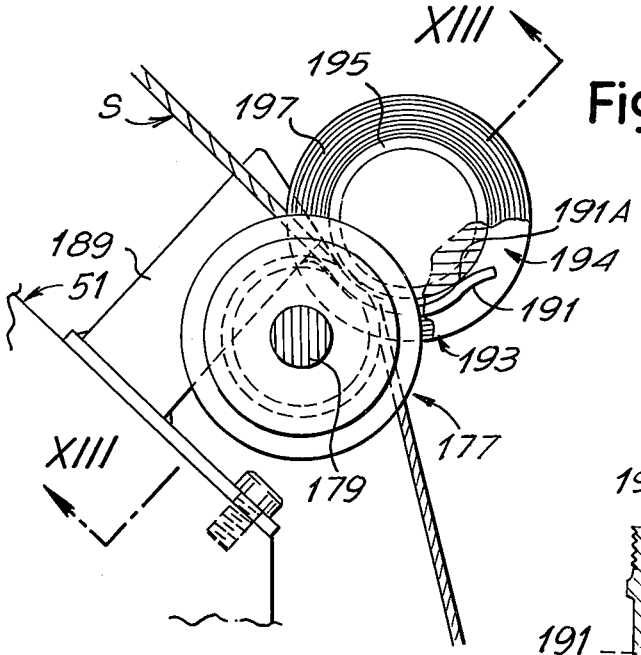
Fig.12
Fig.13
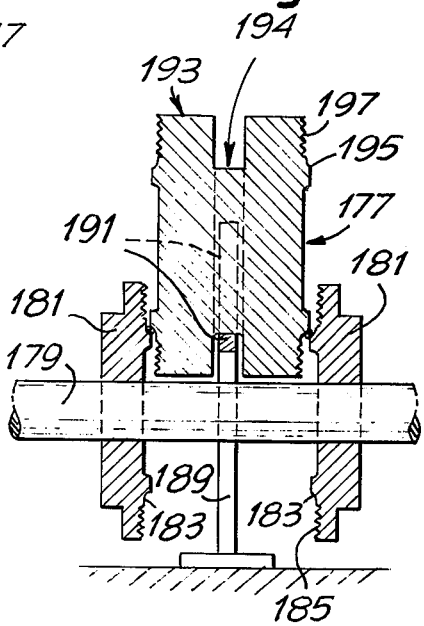
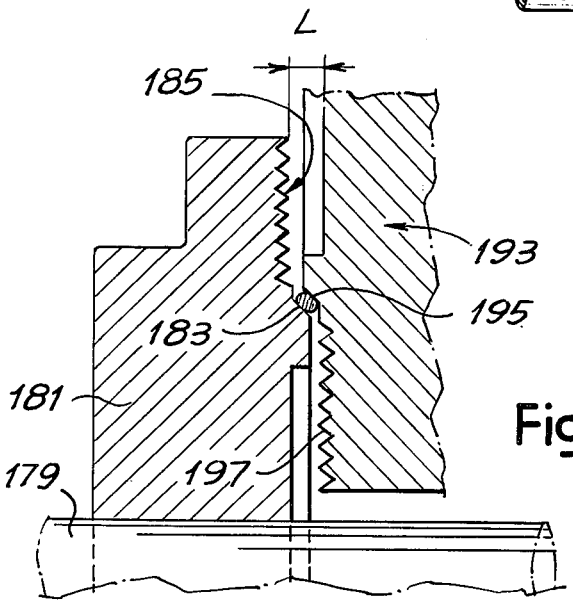
Fig.14

FALSE TWIST DRAFTING DEVICE FOR CONTINUOUS WORKING OF SLUBBINGS OF TEXTILE MATERIALS

FIELD AND SUMMARY OF THE INVENTION

The present invention refers to an improved device for the false twist drafting of textile material in the form of slubbing. The device conually operates in combination with continuous spinners of the "selfacting" or "ring" type or the like. The device includes two offset and opposite rotating members in order to form portions of rotating walls with annular shoulders which are approximately cone-shaped and surrounded by circular crown front surfaces at right angles to the axis of rotation of the members. The surfaces are partially opposed while the shoulders cooperate tangentially to perform a twist and a draft on the slubbing.

According to the invention, one of the members is mounted to protrude toward the other member, thereby the material may be easily inserted sideways between the two opposite members.

In a possible embodiment of the invention, the members are axially urged toward each other and one of the two rotating members is cantilever mounted on its own shaft on the side facing the other member.

In another possible embodiment of the invention, pairs of spaced apart members are provided on a drive shaft, presenting on their facing fronts, the shoulders and the crown surfaces, and a body of revolution is provided between the two members of each pair which presents two opposite fronts each of which being opposed to the inner front of one of the two members and shaped like the front of it. The body abuts with its own shoulders on those of the two members, is rotatively driven by them and cooperates with them in order to treat two slubbings.

BRIEF DESCRIPTION OF THE DRAWINGS

The drawings show some non-limitative practical examples of the invention wherein:

FIG. 1 is an assembly and schematic view showing use of the invention;

FIG. 2 is an enlarged detail of the device for the treatment of a slubbing according to the invention.

FIG. 3 is a view taken substantially along the line III—III of FIG. 2;

FIG. 4 is a detail of the two false twist members of FIG. 2;

FIGS. 6, 7 and 8 show detailed sections on lines VI—VI, VII—VII and VIII—VIII of FIG. 5;

FIG. 9 is an elevational with FIG. 10 taken on line X—X of FIG. 9, to illustrate a variant of the invention.

FIG. 11 is in front elevation of a modified embodiment;

FIG. 12 is an enlarged detail of another device for the treatment of a slubbing;

FIG. 13 is a sectional view taken substantially on to line XII—XII of FIG. 12;

FIG. 14 is an enlarged detail of FIG. 13; and

DESCRIPTION OF THE PREFERRED EMBODIMENTS

Figure 5:
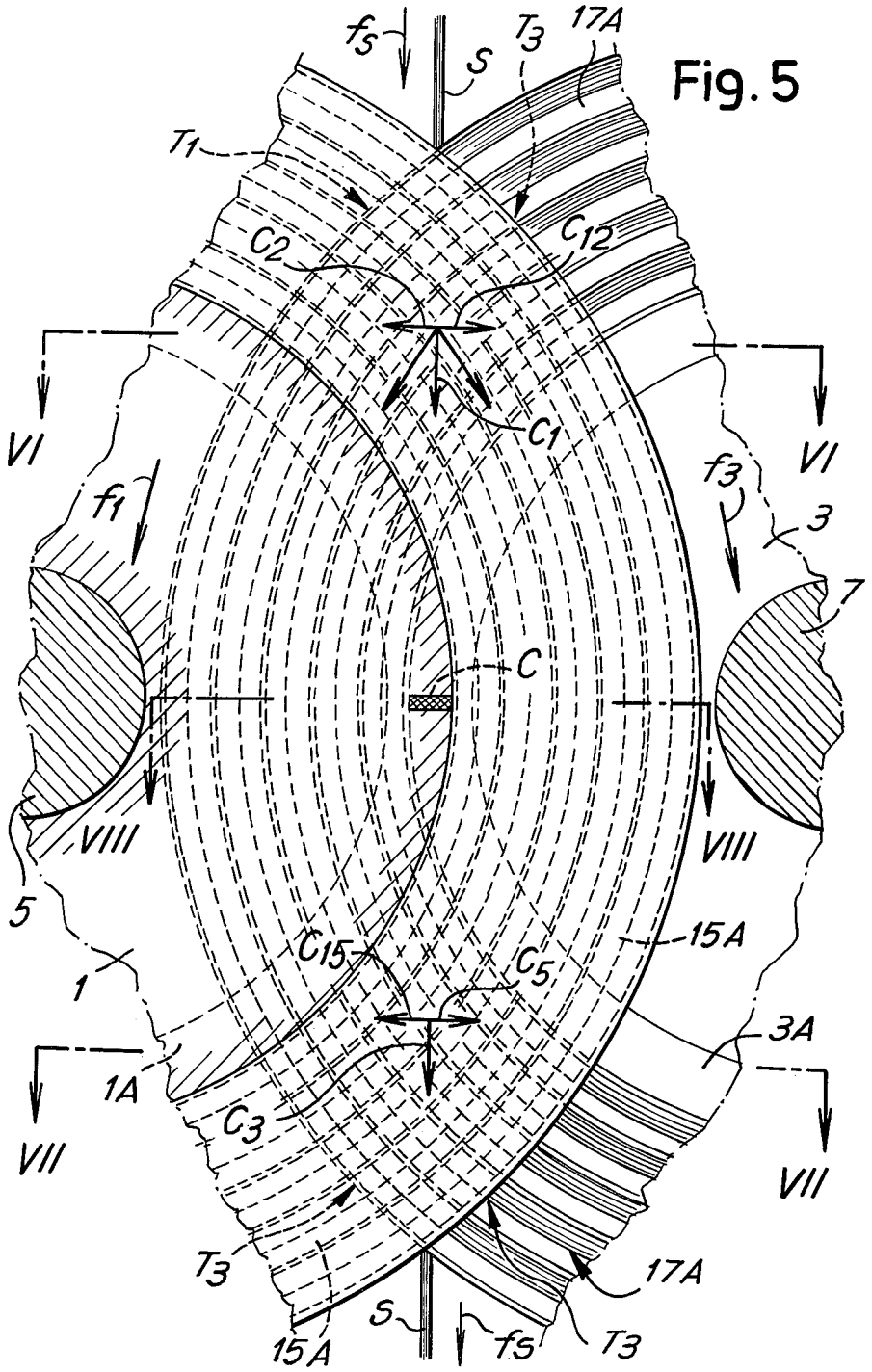
FIG. 5 is a view of a detail of the member surfaces during working.

In FIGS. 1 to 3, 51 indicates the structure of a continuous spinning machine of the so-called "ring" type, with a support 53 for a beam 55 of textile material in the form of slubbing to be spinned, which partially rests on a cylinder 57 which actuates the unwinding of the slubbings S at a constant speed. 59 and 61 indicate small cylinders for feeding the slubbings to the working spans. 63 indicates a thread guide for guiding the thread to an axial position over the relevant spindle 65. Cops 67 are successively inserted on the spindle for the formation of yarn bobbins. The spindle is made to rotate, for example, through belt means 69. 71 indicates the frame making up the ring races for spinning the yarns fed through the thread guides 63. The rotation of the spindle and the reciprocating axial movement between the frame 71 and the spindles, as well as the relative progressive axial displacement between the assemblies, cause the yarn formation along the so-called balloon 73 and the thread winding in the form of reels or cops 75, the relevant ring of each spindle sliding in its own race on the frame 71 around the spindle. A false twist draft is carried out between cylinders 59, 61 and the spinning assembly by a device 77 whose construction and operation is described below.

Along the front of the spindles and above them, a horizontal shaft 79 is supported by the structure 51 and is rotated by the actuating members of the machine. On this shaft and in rotation therewith, friction cylinders 81 are mounted and spaced apart by a pitch corresponding to the one between the spindles 65. Shoulders 83 for spring means 85 are also mounted on shaft 79 for rotation therewith. Between each friction cylinder 81 and each shoulder 83 on shaft 74, a rotating discoidal member 87 is axially slidable, and mounted for rotation with the shaft. In correspondence with each spindle, the structure 51 bears also a support 89 with an arm 91, on which a second member 93 is rotatable and is supported by a shaft 94 protruding toward the rotating member 87. This member 93 may be either idly mounted on or integral to the shaft 94 which, in turn, is idly mounted on the support 89, 91. The shaft 94 is parallel to the shaft 79. The member 93 presents a cylindrical friction surface 95 which is able to cooperate with the respective friction cylinder 81. The arrangement of the support 89, 91 and rotating member 93, 95 is such that the friction cylindrical surface 95 abuts on the friction cylinder 81 to receive the rotation movement from it and thus from the shaft 79. Only one or every one of the surfaces will be elastic. The member 93, being in an axially fixed position, is pressed by the rotating member 87 which is axially urged by the spring 85. The members 93, 95 are cantilever mounted all in the same direction in order to result opposite to the respective rotating members 87 which are urged by respective springs 85.

The cooperation between each member 93 and the relevant member 87, performed in the manner described afterwards, imposes a false twist and a draft to the slubbing in the length between the pair of cylinders 59, 61 and the pair of members 87, 93. The false twist is lost at the outlet of the assembly 77 made up of the operational members 87 and 93, while the material is subjected to the twist due to the ring spinning assembly described above, the twists reaching the material—through the thread guide 63—upon its leaving the device 77.

In the variant shown in FIGS. 9 and 10, the transmission between the shaft 79 and each rotating means 93 is achieved through toothed crowns 81A and 95A—rather than by friction between the elements 81 and 95—whose pitch circles have identical diameters, as also the active surfaces of elements 81 and 95 have identical diameters, to obtain in any case a transmission ratio of 1:1 and opposite rotation directions of the two members 87 and 93.

The way of operation of each false twist device represented by the pair of members 87 and 93 will now be described with reference to FIGS. 4 to 8. In FIGS. 4 to 8, the active members for acting on a slubbing S and causing its stretching comprise two rotating members here denoted by 1 and 3 and corresponding to the members 87 and 93, mounted on the two shafts here denoted by 5 and 7 and corresponding to the shafts 79 and 94. The shafts are parallel and rotate in opposite directions, as indicated by arrows f1 and f3, in order to have a concordant downward direction of rotation in the zone of maximum closeness between the two members 1 and 3, such direction being concordant to the one indicated by arrow fS of downward advancement of the slubbing S. The two members 1 and 3 are mounted in opposite directions and result in contact with each other along a short segment in correspondence with tapered circular shoulders indicated by 1A and 3A of the two members 1 and 3 respectively. The profile of the tapers 1A and 3A may be slightly different from the surfaces having a truncated cone shape and, in any case, ensure a substantially continuous contact along a profile length where the two circular shoulders overlap. It will be noted from the drawing that the two surfaces 1A, 3A having a truncated cone shape and face the offset and opposite members 1, 3, present the laying plans of the minor and major basis offset between them. The distance between the plans containing the minor basis of the surfaces 1A, 3A is indicated by L. By adjusting the position of the members 1 and 3 on the shafts 5 and 7 and by adjusting the center distance between the shafts 5 and 7, it is possible to vary the distance L. A support may be provided between the two members 1 and 3 in a direction which is at right angles to the two shafts 5 and 7. The two members 1 and 3 may be mounted on the shafts 5 and 7, so that in addition to the rotation coupling, they can be urged in order to axially slide in opposite directions to each other according to arrow f7 (FIGS. 3 and 8) on the shaft 5, corresponding to the shaft 79 of FIGS. 1 to 3.

The members 1 and 3 of each working group present, outside the shoulders 1A and 3A, respective surfaces 15A and 17A which overlap in two zones T1 and T3 shown in FIG. 5. The frontal surfaces 15A and 17A superimpose also on the frontal surfaces inside the shoulders 3A and 1A. The interspace between surfaces 15A and 17A corresponds to the one indicated by L as defined above between the minor basis of the frontal end surfaces inside the shoulders 1A and 3A of the members 1 and 3. As a consequence, the adjustment of the relative position between the members 1 and 3 and thus the distance L, determines also the interspace between the frontal surfaces 15A and 17A which overlap at the zones T1 and T3. The surfaces 15A and 17A may be suitably roughened and, in particular, they may present annular concentric grooves which cross at zones T1 and T3. In FIG. 5, C generically denotes the zone of contact, that is the segment of contact between the two tapered surfaces 1A and 3A. Considering in particular the sectional views of FIGS. 5, 6 and 7, it will be noted that—owing to the rotations according to arrows f1 and f3 of the members 1 and 3—the opposite portions of the surfaces 15A and 17A at the zones T1 and T3 are provided with movements which can be resolved into concordant longitudinal components C1, C3 and opposite transversal components C2, C12 in correspondence of the zones T1, and C5, C15 in correspondence of the zones T3. At the segment C of contact between the shoulders 1A and 3A, there occurs only a longitudinal component according to arrow fS, that is according to the sole components C1 and C3 of the contact reactions at that point.

The inserted slubbing S moves approximately tangent—in the contact segment C—to the surfaces of shoulders 1A and 3A, and it is stretched in the direction of arrow fS due to the effect of the direct action of contact with it by the surfaces 3A and 1A in the zone of segment C, and partly due to the effect of components C1 and C3 in the zones T1 and T3 of opposition between the surfaces 15A and 17A. Upstream of the contact segment C, the slubbing S, in addition to undergoing drafting for the reasons stated above, is also subjected to a twist due to a friction effect as a consequence of components C2 and C12 acting on the slubbing with a counter-clockwise torsion in zone T1 as illustrated in FIG. 4. Accordingly, in the zone there occurs a temporary or false twist which is present just at the drafting zone. This false twist is eliminated just beyond the contact segment C, in the zone T3 downstream of the contact segment C, owing to the effect of the torque acting in a clockwise direction (See FIG. 7) and due to components C5, C15. Just beyond the point of contact—represented by segment C—between the textile material and the members 1 and 3, the material in transit may also be effected by the final torsion of the spinning members illustrated in FIG. 1, or by the temporary or false twist of a second drafting and false twisting group.

At the beginning or in case of breakage, the slubbing which is drawn near the rotating members, immediately and spontaneously assumes the working arrangement (substantially symmetrical in the axial views of the device) due to the components acting upon it as soon as it is inserted between the annular elements 15 and 17, or 87 and 93, respectively. Thus, it is a particularly easy task to watch the multiple draft groups provided in a continuous drawing frame and achieved as described above.

Substantially, referring again to FIGS. 1 to 3, due to the action of the device 77 on each slubbing S there is obtained a draft in the free span length between the pair of cylinders 59, 61 and the device 77, owing to the greater return speed of the thread provided by the members 87, 93 of the device 77 with respect to the surface velocity of rollers 59, 61. Such a draft is accompanied by false twist, thereby getting a slubbings regulation with the draft of same slubbings. Most of the false twist is lost after passing the pair of members 87, 93, while the twists of the ring spinning assembly take place at this moment reaching the material upon its outlet from device 77.

At the beginning of the work or on occasion of thread breakage, the material may be easily inserted by the operator between the members 87, 93 of each device 77 always in the same direction according to arrow fx. The material, once inserted in the above mentioned manner, automatically sets itself in the right arrangement already illustrated. This arrangement, instead of having a substantially straight orientation, may be developed according to two slightly inclined lengths, that is as shown in FIGS. 2 and 11, rather than as shown in FIGS. 4 and 5, without altering the system operation.

In order to facilitate the material insertion according to arrows fx, there may be provided at the back of the pairs of members 87, 93 respective shaped stems 100, which guide the material to the correct position where it is subjected to draft and false twist.

In FIG. 11 another embodiment is shown, according to which, rotating members 487 (analogous to those indicated by 87) are mounted on the shaft 479 (equivalent to that indicated by 79) and arranged two by two in opposite directions and thus with the active surfaces facing each other and spaced apart, as well as urged one toward the other. Between the two members 487 there is provided either a friction cylinder 481, or a cylinder with two toothed crowns. In the spacing between the two members 487, a support 489 bears two rotating members 493 (equivalent in those indicated by 93) overhanging at their opposite sides, facing in opposite directions and each one cooperating with the corresponding member 487. In this instance, the insertion of the material between the two specularly symmetrical false twist devices must be carried out according to arrows F2 which are symmetrically inclined. In this case, the false twist is imposed in opposite directions to the two adjacent slubbings S1 and S2 fed by the unit described above and illustrated in FIG. 1, while in the previously described solutions, where the members 93 are oriented in the same direction, the twist is concordant in all the fed slubbings.

The transmission of rotation by friction is simpler and more silent, but it may give rise to some alterations of the transmission ratio in case the material should bunch around a friction surface. On the contrary, a gear transmission does not give rise to alterations of the transmission ratio.

In the embodiment of FIGS. 12 to 14, the assembly of a continuous spinning machine of the so-called ring type is analogous to the one illustrated in FIG. 1 and presents a false twist device 177 in place of that indicated by 77 already described.

Along the front of the spindles and above them, a horizontal shaft 179 carried by the structure 51 is put into rotation by the actuating members of the machine. At pitch spacings corresponding to that between the spindles 65, pairs of members 181 are mounted on the shaft 179 and rotate therewith; each of the members 181 presents a working front with an annular shoulder 183 having a conical profile and a surface 185 outside the shoulder and developed as a circular crown with annular grooves or other friction surfaces. In correspondence with each spindle there is the front of a member 181. Between two facing members 181, the structure 151 bears also a support 189 with an arm 191 forming a saddle within which a body of revolution 193 is housed and rests at a point on the arm 191 as well as on the two shoulders 183 of the two discoidal members 181 approximately facing each other and spaced apart by the distance measured between the faced fronts of the two members 181. More particularly, this body 193 is approximately cylindrical and presents an intermediate annular throat 194 for housing the arm 191, which thus guides the body 193. The body 193 also has two bases facing the shaped fronts 183, 185 of the two members 181 and shaped like these fronts, that is each one having a conical annular shoulder 195 and a circular crown surface 197 with grooves or other friction faces, able to cooperate with the respective friction surface 185 of the opposite front, while the shoulders 195 rest on the respective shoulders 183, so that the body 193 rests on the shoulders 183 and with the bottom of the throat 194 which comes in contact at the point 191A (FIG. 12) with the arm 191. The body 193 may be easily removed from and laid on the members 181, 181, 191 without difficulty, and may be driven into rotation by the shoulders 183. The further contact at 191A may be also carried out through a rolling means in order to reduce friction.

The cooperation between each front 183, 185 of a member 181 and the relevant opposite front or base 195, 197 of a body 193, imposes—in the manner described below—a false twist and a draft to the slubbing over the length between the pair of cylinders 61 (FIG. 1) and the pair of members 181, 193 of the unit 177, the slubbing passing through the shoulders 183 and 195. The false twist is lost at the outlet of the unit 177, while the twist due to the spinning assembly takes place on the material. The twists reach—through the thread guide 61—the material just leaving the unit 177.

The operation of the device 177 is completely analogous to the one described with reference to FIGS. 4 to 8.

Figure 15:
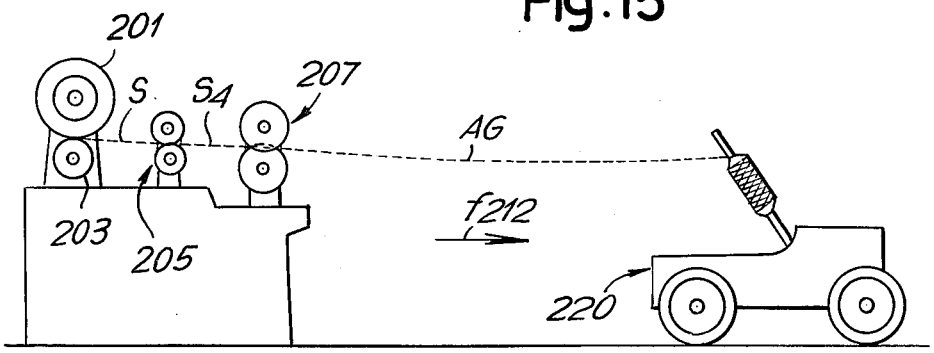
FIGS. 15 and 16 show schematic assembly views of two applications to a selfacting spinner and to a divider for carding assortment.

While FIG. 1 shows an installation of the device in a continuous ring spinner, FIG. 15 shows instead an installation of the device in an intermittent (self-acting) spinner. In this instance, the slubbings of the cop or beam 201 are unwound by the support cylinder 203. A pair of cylinders 205 feeds the slubbings to the draft and twist device 207 formed according to any of the ways already described. The slubbing S undergoes the draft and false twist over the length S4 between the units 205 and 207. The stretched slubbings leaving the devices 207 form the "stretch" AG which is called back by the spindles carriage 220 when it goes away according to arrow f212 to form the yarn. The devices 207 are operated, in this case, with intermittent movement synchronized to the slubbings feed.

Figure 16:
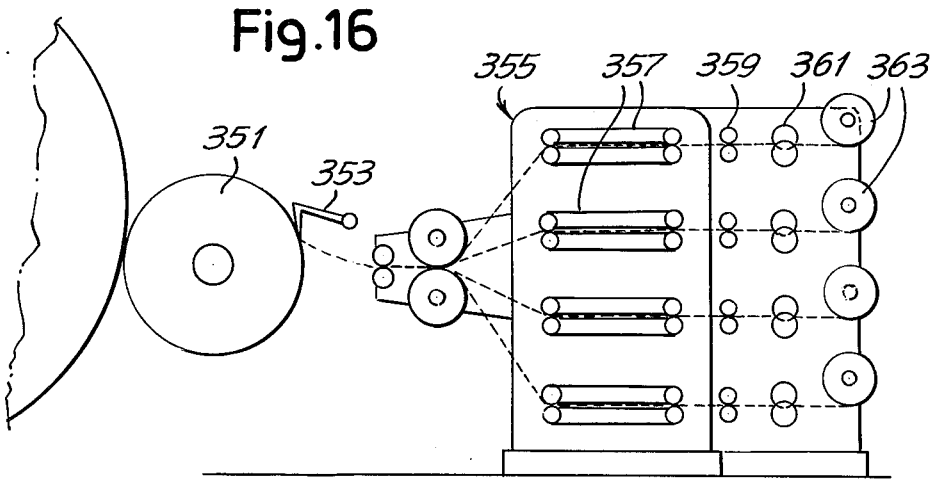

FIG. 16 shows an application of the invention to the divider of a carding assortment, where 351 denotes the doffer, 353 the comb, 355 the dividing unit with the pairs of rubbing leathers 357. At the outlet of the latter there may be possibly provided a pair of feeding cylinders 359 and a device 361 of a type described earlier, for the draft and false twist. The material is then wound around the beams or reels 363 for the next spinning operation.

It will be understood that the drawing shows only an example given as a practical demonstration of the invention, which may vary with regard to form and disposition without coming leaving the basic idea of the invention itself.

What is claimed is:

1. A false twist drafting device for slubbings of textile material, comprising:

a frame support;

a first shaft rotatably mounted to said frame support;

at least two spaced apart first rotating members each having a first radially extending frontal surface and mounted for rotating with with said first shaft;

at least two second shafts rotatably mounted to said frame support, being parallel to said shaft and axially offset from said first shaft, each of said second shafts having a free end;

a second rotatable member having a second radially extending frontal surface and mounted for rotation with each of said second shafts at each free end to expose at least a portion of each second frontal surface and so that each second member overhangs each free end;

said first and second frontal surfaces of one of said first and second members and said first and second frontal surfaces of the other of said first and second members facing and partly overlapping each other at a contact area for receiving textile to be drafted therebetween, each of said first and second frontal surfaces having a conical annular shoulder, with said conical annular shoulders of said overlapping first and second frontal surfaces approaching each other near a center of said contact area and extending tangentially to each other at said center of said contact area, each of said frontal surfaces having a toothed crown area surrounding and extending outwardly of each conical annular shoulder respectively for drafting textile in said contact area;

transmission means for transmitting rotation of one of said first and second shafts to the other of said first and second shafts so that said first shaft rotates in a direction opposite to said second shafts; and biasing means for axially moving one of said first and second members with respect to the other of said first and second members to bias said first and second frontal surfaces together in said contact area.

2. A device according to claim 1, including a curved guide element connected to said frame support and curved toward said exposed portion of each of said second frontal surfaces for guiding textile material into said contact area between said overlapping first and second frontal surfaces.

3. A device according to claim 2, wherein said transmission means comprises at least two spaced apart friction cylinders rotatably mounted on said first shaft each associated with one of said first rotable members and a cylindrical friction surface defined on each of said second shafts and engaged with each of said friction cylinders respectively.

4. A device according to claim 2, wherein said transmission means comprises a pair of spaced tooth crowns rotatably mounted on said first shaft each associated with one of said first rotatable members and a further toothed crown rotatably mounted with each of said second shafts and meshing with each of said first-mentioned tooth crowns respectively.

5. A device according to claim 2, wherein said at least two second shafts are connected to each other and extend axially outwardly from a common portion of said support frame, said second frontal surfaces facing away from each other, said first frontal surfaces facing toward each other.

6. A device according to claim 5, wherein said transmission means comprises a first friction cylinder rotatably mounted with said first shaft associated with both of said first rotatable members and a friction cylinder on said two connected second shafts on either side of said common frame support portion engaged with said first friction cylinder.

7. A device according to claim 2, wherein said first rotatable members are mounted on said first shaft with said first frontal surfaces facing in the same direction, said second frontal surfaces facing in the same opposite direction.

8. A device according to claim 1, including a continuous ring type spinning assembly for supplying textile material to said contact area.

9. A device according to claim 1, including a self-acting spinning assembly for supplying textile material to said contact area.

10. A device according to claim 1, including a carding assortment divider associated with said device for receiving twist drafted textile material after it leaves said contact area.

* * * * *